United States Patent [19]

Carluccio

[11] 4,390,298

[45] Jun. 28, 1983

[54] UNIVERSAL WIPER PLUG FOR LIQUID COSMETIC PRODUCTS

[76] Inventor: John F. Carluccio, 836 High Mountain Rd., Franklin Lakes, N.J. 07417

[21] Appl. No.: 313,367

[22] Filed: Oct. 21, 1981

[51] Int. Cl.[3] ..... A46B 11/00

[52] U.S. Cl. ..... 401/122; 15/257.05; 132/88.7; 401/129

[58] Field of Search ..... 401/121, 122, 129; 15/257.05; 132/88.7, 88.5

[56] References Cited

U.S. PATENT DOCUMENTS

| | | | |
|---|---|---|---|
| 2,627,619 | 2/1953 | Gagen | 401/122 X |
| 3,280,421 | 10/1966 | Davidson | 401/122 |
| 3,372,424 | 3/1968 | Kellett | 401/122 X |
| 3,684,387 | 8/1972 | Glenn | 401/122 |
| 4,332,494 | 6/1982 | Kingsford | 401/122 X |

*Primary Examiner*—Steven A. Bratlie
*Attorney, Agent, or Firm*—Brumbaugh, Graves, Donohue & Raymond

[57] ABSTRACT

A wiper plug for use in a dispenser for liquid cosmetic products removes excess liquid on the rod and head of a cosmetic applicator when the applicator is withdrawn from the bottle. The wiper plug has a body with an axial opening, and a resilient wiper section that defines an extension of the axial opening, preferably of decreasing diameter, and terminates in a lower wiper edge. The wiper section has one or more cuts or slots therein extending axially from the wiper edge, such that the wiper edge defines a radially enlargeable wiper opening that is resiliently held against the rod and head of the applicator to remove excess liquid on the rod and head when the applicator is withdrawn axially through the opening. In one form, the cut or slot is helical, such that the action of withdrawing the applicator causes the wiper edge to be drawn in and around the rod and head. The wiper section may also be in the form of plural, closely spaced sections, defined by plural, axially cuts or slots extending from the lower edge opening toward the plug body.

4 Claims, 6 Drawing Figures

UNIVERSAL WIPER PLUG FOR LIQUID COSMETIC PRODUCTS

BACKGROUND OF THE INVENTION

The present invention is an improvement in a wiper plug of the type commonly used in bottles containing liquid cosmetic products of the type applied using a rod applicator.

Typically, liquid cosmetics are applied by using a rod applicator, which is stored in a bottle containing the cosmetic. The applicator includes a handle, part of which may be a cap for the bottle, and a rod or wand that extends from the handle and can be inserted into the cosmetic bottle. An applicator head is disposed at the end of the rod for applying the cosmetic. Depending upon the application, the applicator head can take the form of a brush, of transversely arranged bristles, or of solid polyurethane foam. The applicator rod and head are inserted into the cosmetic bottle through the opening in a wiper plug which is fitted into the upper end of the bottle. The wiper plug removes excess liquid from the rod and brush as the applicator is withdrawn from the bottle, such that only a desired amount of liquid remains on the applicator head.

Normally, the wiper plug must be designed and sized for each particular application. Also, the plug often fails to remove entirely the excess liquid, for example on the rod where an over-sized applicator head is present.

SUMMARY OF THE INVENTION

The present invention is an improved wiper plug for liquid cosmetic products which is uniform in application and which effectively removes excess liquid from the rod and the head of the applicator as it is withdrawn from the cosmetic bottle.

More particularly, a universal wiper plug in accordance with the invention includes a plug body with an axial opening therethrough, and a wiper section formed of resilient material extending axially from the plug body. The wiper section defines an extension of the axial opening of decreasing diameter toward a lower rim or wiper edge in the form of a radially enlargeable wiper opening that is resiliently pressed against the appicator rod and head to remove excess liquid when the applicator is withdrawn axially through the opening.

The wiper section may be formed integrally with the plug body and may be formed from a single conical section of material with one or more axially extending or helically extending cuts or slots. In the case of a helically arranged wiper section, the action of withdrawing the applicator causes the opening to be drawn in and around the rod and head of the applicator to facilitate the removal of excess liquid.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 1:
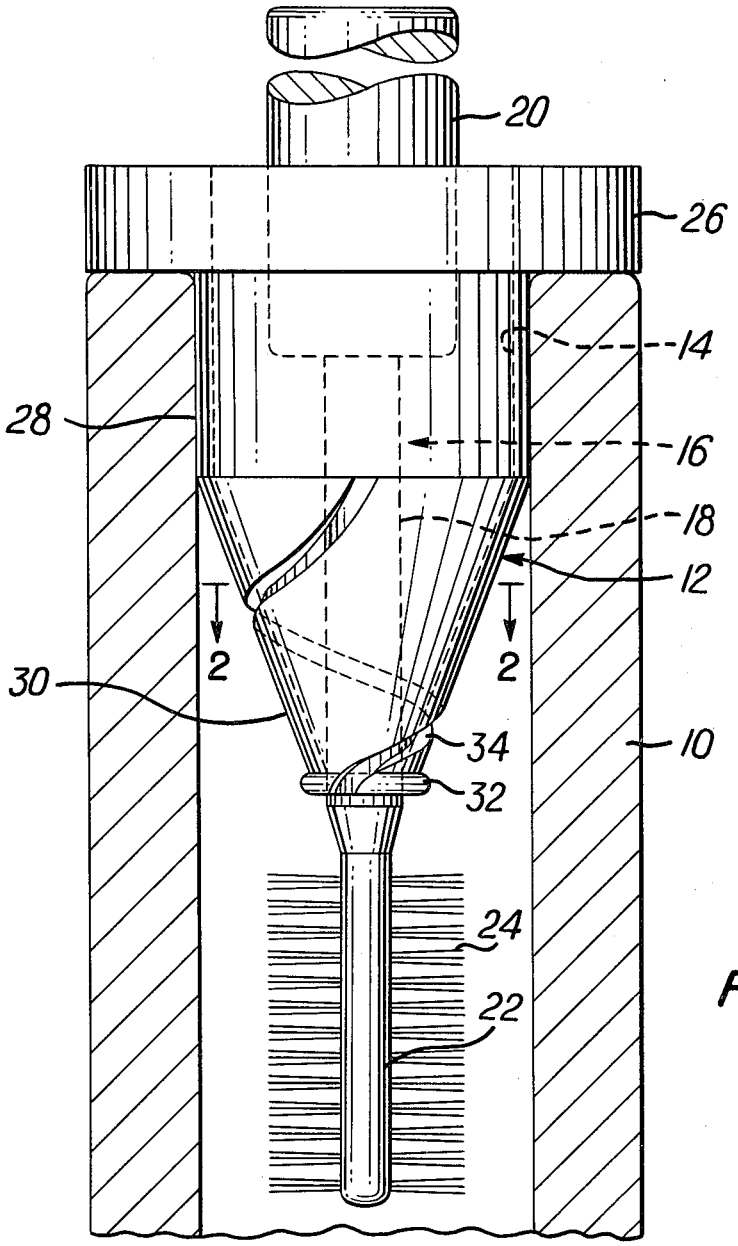
FIG. 1 is a front view of a liquid cosmetic dispenser incorporating a universal wiper plug.
Figure 2:
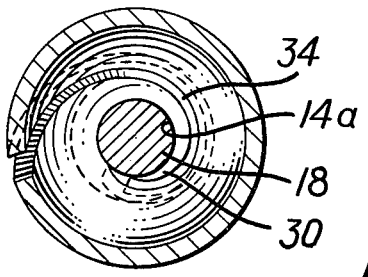
FIG. 2 is a sectional view of the wiper plug shown in FIG. 1, taken through lines 2—2 in FIG. 1 in the direction of the arrows.

In the illustrative embodiment of the liquid cosmetics dispenser shown in FIGS. 1–2, a container 10 for the cosmetic liquid (not shown) has a wiper plug 12 seated therein by neck portion 26, which also forms a seal for the liquid. The plug 12 has an axial opening 14 therethrough for receiving an applicator 16. The applicator has a rod 18 or wand, which is attached at one end to a holder 20. At the other end of the rod 18, the applicator head 22 is provided with a plurality of bristles 24, for example for applying eyelash mascara. Alternatively, the applicator head 22 may take other forms, for example polyurethane foam, or a brush (e.g. for applying nail polish). The applicator handle 20 may also include a cap (not shown), or be formed with a cap portion, which is fitted over or screws onto the container 10 or the neck seal portion 26 of the wiper plug 12 to close the container 10. The cap also functions to position the applicator head 22 axially within the container 10, such that the bristles 24 are inserted into the cosmetic liquid.

In the embodiment shown in FIGS. 1–2, the wiper plug 12 has a plug body 28, and a wiper section 30 of resilient material that extends axially from the plug body 28. As shown, the wiper section 30 is conical and terminates in a lower annular wiper edge or rim 32 of enlarged thickness.

A helical slot 34 extends from the lower edge 32 axially along the wiper section 30 such that the wiper opening **14*a* defined by lower wiper edge 32 is radially enlargeable. When the applicator 16 is fully inserted, the wiper edge 32 of the wiper section 30 wraps around and is resiliently held against the rod 18 of the applicator 16. At the same time, when the applicator is inserted or withdrawn, the opening 14*a* enlarges to accommodate the larger diameter bristles 22 or other enlarged applicator heads. Moreover, when the applicator 16 is withdrawn, the rod 18 and head 22 pull the wiper edge 32 axially, and the wiper edge 32, due to the helical construction of the wiper section 30, is drawn in and around the rod 18 and thereafter the head 22** of the applicator to effectively remove excess liquid on the rod and head.

The wiper plug may be used with different diameter rods and applicator heads, since the diameter of opening **14*a* will adjust as needed. In each case, the action of withdrawing the applicator tends to close-off the opening 14*a*, such that irrespective of the diameter of the rod 18 and the applicator head, the wiper edge 32 is held closely against the rod and against the head as each section passes through the opening 14*a***.

Figure 3:
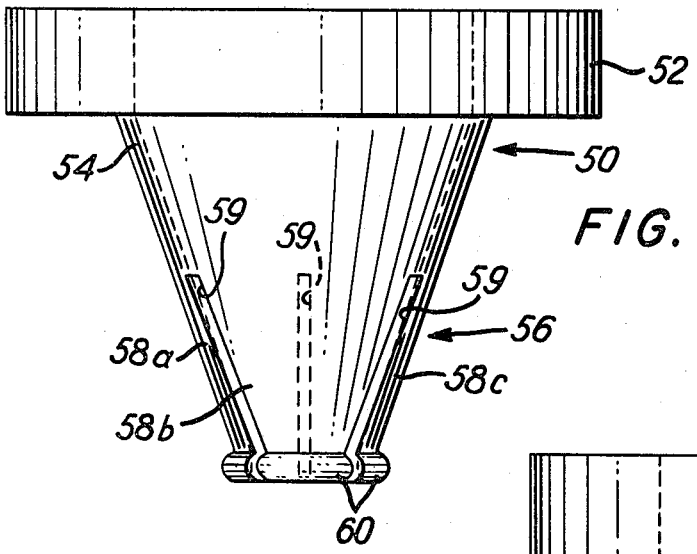
FIGS. 3 and 4 are front and bottom views, respectively, of a modified form of wiper plug.
Figure 4:
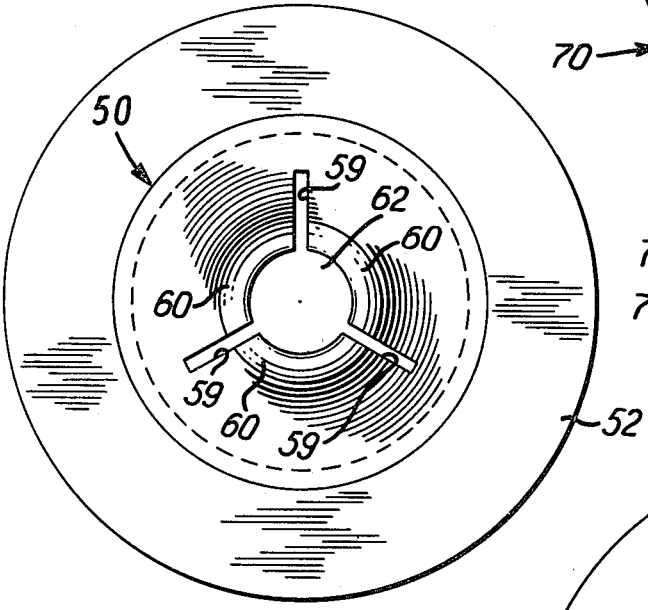

A modified form of wiper plug is shown in FIGS. 3 and 4. The plug 50 includes a neck seal portion 52 which forms part of the plug body 54. The plug body 54 supports a wiper section 56 that includes three closely spaced, V-shaped portions of resilient material **58*a*–*c*, formed by axially extending slots 59. The wiper portions 58*a*, 58*b*, and 58*c* terminate in a wiper edge 60 of enlarged thickness. The enlarged thickness wiper edge 60 defines a wiper opening 62** that is resiliently held against the applicator rod and head or bristles and is radially enlargeable to accommodate applicators of different dimensions and to accommodate the passage of different diameter sections of the applicator.

Figure 5:
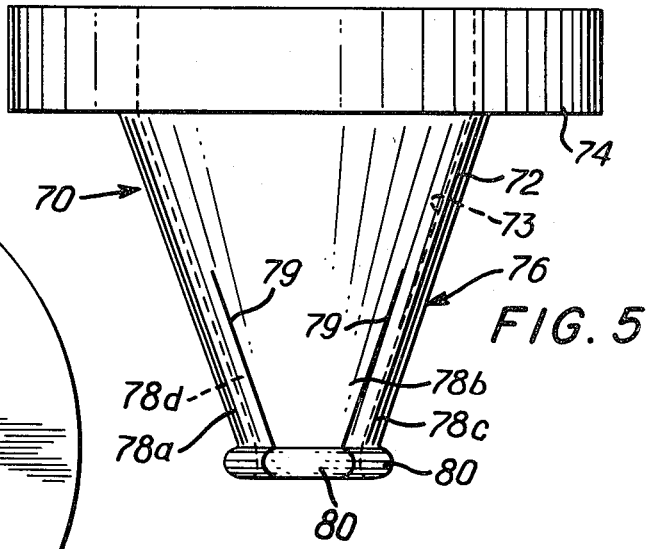
FIGS. 5 and 6 are front and bottom views, respectively, of another embodiment of a wiper plug in accordance with the invention.
Figure 6:
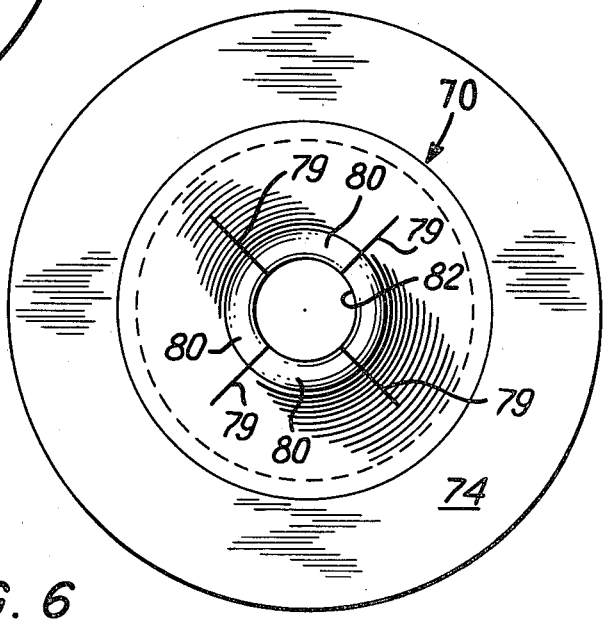

FIGS. 5–6 illustrate another embodiment of wiper plug in accordance with the invention. The plug 70 has a plug body 72 with an axially extending opening 73 therethrough to receive an applicator. Once again the plug may be provided with a seal portion 74 for mounting the plug in a cosmetic bottle. A conically shaped wiper section 76 extends axially from the plug body 72 and has four, closely spaced portions 78*a–d* of resilient material, formed by cuts 79, terminating in a lower wiper edge 80 of enlarged thickness. The wiper edge 80 of the wiper portion 76 defines a wiper opening 82 which, similar to the opening 62 in the FIGS. 3–4 embodiment, is resiliently enlargeable in the radial direction, and is thus resiliently held against the rod or head of an applicator of varying diameters.

The foregoing represents the preferred embodiments of the invention. Variations and modifications of the embodiments disclosed will be apparent to persons skilled in the art without departing from the inventive concepts disclosed herein. By way of example, while in the FIGS. 1–2 embodiment the wiper section was made radially enlargeable using a single helical slot, two or more helical slots or helical cuts may be formed in the wiper section. Also, the wiper portion need not be formed integrally with the plug body, or of a single piece of material. As used herein, the term "cut" or "slot" refers not only to such formed in a single piece of material, but also to a slot or cut defined by forming the wiper section from plural pieces of material. All such modifications and variations are intended to be within the scope of the invention as defined in the following claims.

I claim:

1. A wiper plug for liquid cosmetic products, for removing excess liquid on the rod and head of a cosmetics applicator, comprising:

a plug body having an axial opening therethrough;

a resilient wiper section extending axially from said plug body and having a lower wiper edge remote from said plug body, wherein said wiper section has at least one of a cut and slot therein extending axially from said wiper edge toward said plug body such that said wiper edge forms a radially enlargeable wiper opening adapted to be resiliently held against the rod and head of a cosmetic applicator inserted therethrough, to remove excess liquid on the rod and head when the applicator is withdrawn axially through said wiper opening, wherein said at least one of a cut and slot is helical such that the action of withdrawing a cosmetics applicator through said opening causes said lower wiper edge to be drawn in and around the rod and head of the applicator.

2. A wiper plug as defined in claim 1, wherein said wiper section defines an extension of said axial opening of decreasing diameter toward said wiper edge, and wherein said lower wiper edge has an enlarged thickness.

3. In a dispenser for cosmetic products comprising a container, a wiper plug mounted in said container having an axial opening therethrough, and an applicator having a rod and head adapted to be inserted in said container through said opening, the improvement wherein said plug comprises:

a plug body containing said axial opening;

a wiper section, extending axially from said plug body, of resilient material having a lower wiper edge remote from said plug body, wherein said wiper section has at least one of a cut and slot therein extending axially from said lower wiper edge toward said plug body such that said wiper edge forms a radially enlargeable wiper opening and is resiliently held against the rod and head of a cosmetics applicator inserted therethrough to remove excess liquid on the rod and head when the applicator is withdrawn axially through said wiper opening, wherein said at least one of a cut and slot is helical such that the action of withdrawing a cosmetics applicator through said opening causes said lower wiper edge to be drawn in and around the rod and head of the applicator.

4. The improvement in accordance with claim 3, wherein said wiper section defines an extension of said axial opening of decreasing diameter toward said lower wiper edge, and wherein said lower wiper edge has an enlarged thickness.

* * * * *